United States Patent [19]

Gassner et al.

[11] Patent Number: 4,624,401

[45] Date of Patent: Nov. 25, 1986

[54] DEVICE FOR DRIVING FASTENING ELEMENTS

[75] Inventors: Theo Gassner, Triesenberg, Liechtenstein; Rolf Fehr, Buchs, Switzerland

[73] Assignee: Hilti Aktiengesellschaft

[21] Appl. No.: 755,422

[22] Filed: Jul. 16, 1985

[30] Foreign Application Priority Data

Jul. 16, 1984 [DE] Fed. Rep. of Germany ..... 3426173

[51] Int. Cl.[4] ..... B25C 1/00; B25C 3/00; B25C 5/00; B27F 7/13

[52] U.S. Cl. ..... 227/125; 227/126; 227/127; 227/128; 227/120; 227/147

[58] Field of Search ..... 227/120, 125–128, 227/147

[56] References Cited

U.S. PATENT DOCUMENTS

| | | | |
|---|---|---|---|
| 2,279,584 | 4/1942 | Vogel | 227/126 |
| 2,651,034 | 9/1953 | Vail et al. | 227/125 |
| 3,041,614 | 7/1962 | D'Haem et al. | 227/127 X |

FOREIGN PATENT DOCUMENTS

| | | | |
|---|---|---|---|
| 2163557 | 12/1971 | Fed. Rep. of Germany . | |
| 52-13182 | 2/1977 | Japan | 227/120 |

*Primary Examiner*—Robert L. Spruill
*Assistant Examiner*—Taylor J. Ross
*Attorney, Agent, or Firm*—Toren, McGeady, Stanger, Goldberg & Kiel

[57] ABSTRACT

A device for driving fastening elements, such as nails, staples and the like, includes a magazine extending transversely from a driving unit. A follower is located within the magazine for supplying fastening elements to the driving unit. For filling the magazine with fastening elements, the follower can be secured in a loading position. The follower is secured by a stop pivotally attached to the follower which engages an abutment on the magazine. The follower is released from the loading position by an actuating member movably mounted on the magazine so that it can contact an engagement part on the follower and pivot the stop out of engagement with the abutment.

3 Claims, 4 Drawing Figures

DEVICE FOR DRIVING FASTENING ELEMENTS

BACKGROUND OF THE INVENTION

The present invention is directed to a device for driving fastening elements, such as nails, staples, and the like with a magazine positioned on the device for holding and supplying the fastening elements. The magazine has a first end through which the fastening elements are introduced into a driving unit and a second end in which a follower for directing the fastening elements toward the first end of the magazine can be held in a loading position. In the loading position a stop on the transport follower engages with an abutment on the magazine.

A known device for driving fastening elements includes a magazine for the elements to be driven. The feed of the fastening elements from the magazine is provided by a follower guided in the magazine and biased in the feed direction by a spring. The follower can be moved into a loading position for introducing the fastening elements into the magazine The follower is pulled opposite to the feed direction against the action of the spring whereby the spring is tensioned and subsequently the slider is shifted laterally out of a guidance channel. Such lateral displacement results in a holding action with a stop on the follower engaging an abutment on the magazine.

After the magazine is filled with fastening elements, the follower is returned manually in the feeding position by a slight displacement counter to the feed direction and a subsequent lateral shifting into the guidance channel. The movement of the follower into the loading position as well as the return of the slider into the feeding position requires a certain handling dexterity and may lead to jamming if the device is not handled in a proper manner.

SUMMARY OF THE INVENTION

Therefore, the primary object of the present invention is to provide a device for driving fastening elements with a magazine, as in the previously described type, which can be operated in a malfunction-free manner with the follower being easily moved into the loading position and with an equally simple release of the follower from the loading position after the magazine has been filled with fastening elements.

In accordance with the present invention a stop is pivotally secured on the follower and can be pivoted about an axis extending transversely of the fastening element feed direction end located on the opposite side of the axis from the stop. The follower has an engagement part arranged to be contacted by an actuating member movably mounted on the magazine.

To move the follower into the loading position it only requires the displacement of the follower counter to the feed direction, whereby an automatic latching of the stop on the follower is effected with an abutment on the magazine. The latching is effected by pivoting the stop around a pivot axis provided between the stop and the engagement part. The engagement of the stop with the abutment is maintained by a spring force.

Subsequently, the follower is released from the loading position by an actuating member movably arranged on the magazine for contact with the engagement part on the transport follower. When the actuating member contacts the engagement part, the stop is displaced from engagement with the abutment on the magazine preferably counter to a spring force. Accordingly, the released follower moves, due to spring force, in the feed direction for supplying the fastening elements within the magazine to a driving unit.

Instead of pivoting the entire follower for releasing it from the loading position, it is also possible by an appropriate arrangement of the stop and the engagement part to use only a portion of the follower for securing it in the loading position. In such an arrangement, preferably the stop and the engagement part are formed as separate arms of a rocking lever. It is advantageous to articulate the rocking lever on the follower by an elastic pivot joint defining the pivot axis. Accordingly, the follower, during the filling of fastening elements into the magazine, can remain guided in guidance channels for the nails within the magazine. In this way any danger of a possible jamming of the transport slider due to tilting, is excluded.

The elastic pivot joint can be formed by a bolt extending through the body of the follower with the rocking lever supported on the bolt. Suitably, the rocking lever can be pivoted into the loading position of the slider by a torsion spring or some similar member. If the follower is made from a plastics material it has been shown to be particularly simple to connect the rocking lever integrally with the body of the follower by a pivot joint in the form of a connector web. The connector web can also provide the spring force which pivots the stop into the holding position to the extent that the force acting counter to the pivoting of the connector web can be effected.

In another feature of the invention, the abutment on the magazine is formed as an end shoulder in a recess. If the follower is sufficiently displaced opposite to the feed direction, the stop on the follower pivots automatically into the recess because of the spring force provided in the connector web. The spring force for moving the follower in the feed direction acts to hold the stop against the abutment. A second end shoulder in the recess spaced opposite to the feed direction from the stop can, if the stop is shaped like a finger, serve to limit the displacement travel of the follower opposite to the feed direction with the stop running against the second shoulder.

When considered from the point of view of handling the device, it has proved to be particularly simple to locate the actuating member on a cover for the magazine. After filling the fastening element into the magazine, the cover is moved into the closed position with the actuating member contacting the engagement part and causing the pivotal displacement of the stop out of contact with the abutment. As a result, the follower is released for feeding the fastening elements toward the driving unit.

Another feature of the invention involves the pivotal mounting of the cover on the magazine. For the purpose of simplicity, the actuating member is shaped as a finger protruding inwardly from the cover when it is pivoted in the closing direction. The finger presses against the engagement part when the cover is pivoted into the closed position on the magazine and effects the release of the follower from the loading position.

An especially advantageous loading of the magazine with nails or other fastening elements is attained when the cover is pivotally supported about an axis extending parallel to the feed direction within the magazine. When the cover is pivoted to the open position, the guidance channel in the magazine is completely open and fully accessible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
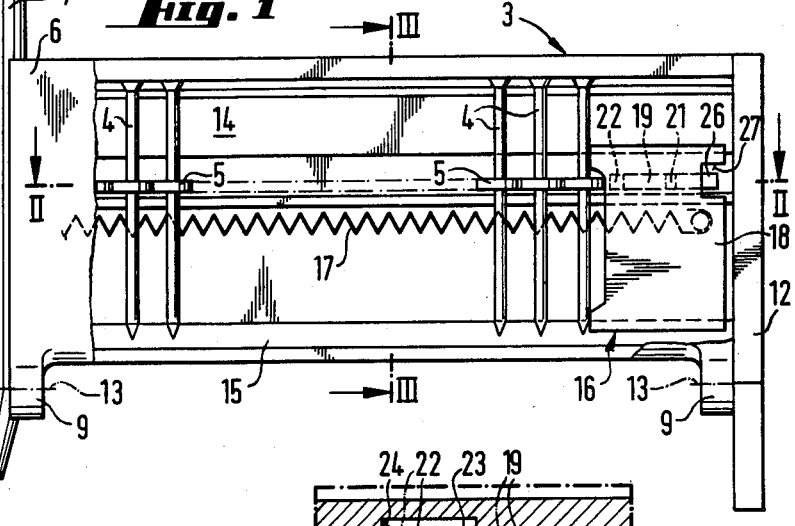
FIG. 1 is a side elevational view of a fastening element driving device, embodying the present invention, with a portion of the magazine member cut away.
Figure 1:
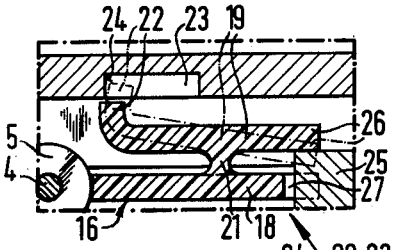

In FIG. 1 a device 1 for driving fastening elements, such as nails, staples and the like is made up of a driving unit 2 located at one end with a magazine 3 secured on the driving unit and extending laterally outwardly from the driving unit. A plurality of nails 4 are positioned in the magazine 3 with the nails being held in a row by plastic rings 5. The magazine 3 includes a cover 6 which can be pivoted between a closed position and an open position.

The drive unit 2 includes a housing 7 with a punch member 8 which can be driven through the housing.

Cover 6 is pivotally supported on the magazine 3 about an axis 13 extending through support eyes 9 provided on the magazine or on a support plate 12 for the magazine. The magazine 3 has a first end, at the left end as viewed in FIG. 1, for supplying fastening elements into the driving unit 2, the opening from the magazine into the driving unit is not illustrated and a second end at the right end in FIG. 1.

Figure 3A:
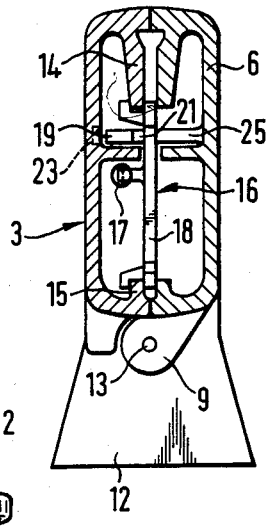
FIG. 3*a* is a sectional view through the magazine taken along the line III—III in FIG. 1 with the magazine cover pivoted into the closed position.
Figure 3A:
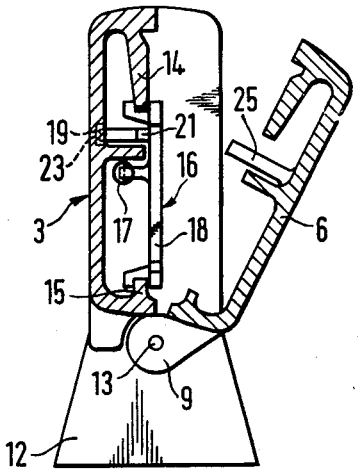
Figure 3B:
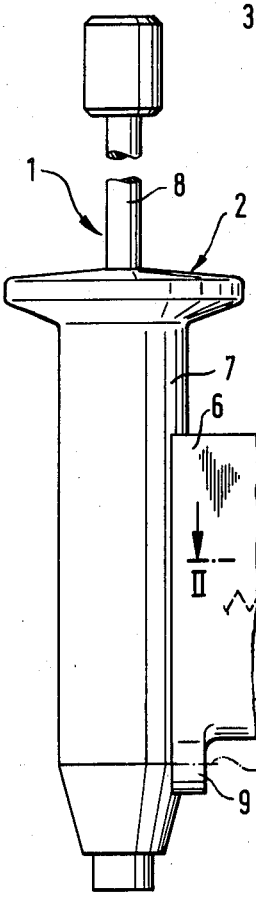
FIG. 3*b* is a sectional view similar to that shown in FIG. 3*a*, however, with the magazine cover pivoted into the open position.

In FIG. 3*a* the cover 6 is in the closed position on the magazine 3 while in FIG. 3*b* the cover is pivoted about the axis 13 into the open position so that fastening elements can be placed within the magazine. In FIG. 1 it can be seen that the axis 13 of the cover 6 extends generally parallel to the feed direction of the fastening elements 4 from the magazine 3 into the driving unit 2.

A follower 16 is located within the magazine 3 so that it can be displaced through the magazine for feeding the fastening element into the driving unit 2 being guided between upper ribs 14 and lower ribs 15. A spring 17 is secured to the follower 16 and biases the follower toward the driving unit 2 for moving the fastening elements 4 into the driving unit.

Figure 2:
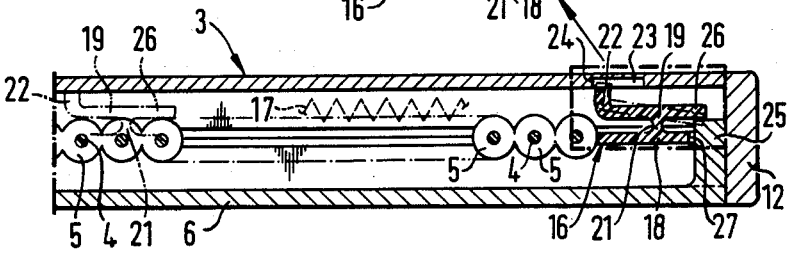
FIG. 2 is a section through the magazine taken along the line II—II in FIG. 1.

As shown in FIG. 2, the follower 16 is made up of a follower 18 which contacts the row of fastening elements 4, and a rocking lever 19 formed on one side of the follower body. Rocking lever 19 is integrally articulated by a connector web 21 with the follower body 18 and the web acts as a pivot joint. The follower 16 including the follower body 18 and the rocking lever 19 are formed of an elastic plastics material so that pivoting of the rocking lever 19 from its neutral or locking position generates a restoring force in the connector web 21.

To fill the magazine 3 with fastening elements or nails 4 as shown in FIG. 1, the cover 6 is pivoted about the axis 13 into the open position as illustrated in FIG. 3*b*. The follower 16 is then moved opposite to the feed direction, that is, in the rightward direction in FIGS. 1 and 2, into the loading position which stretches the spring 17. In the movement of the follower into the loading position, the rocking lever 19 slides under resilient stress along the inside wall of the magazine 3 from the left-hand position indicated by dot-dash lines in FIG. 2 into the right-hand position also shown in dot-dash lines. In the dot-dashed right-hand position, the rocking lever 19 is in the neutral or holding position since the stop 22 has snapped into a recess 23 in the magazine 3. The rocking lever 19 is formed of two oppositely directed arms, one extending from the connector web 21 in the feed direction and forming at its end remote from the web the stop 22. The other arm extends opposite to the feed direction from the connector web and at its end remote from the web it forms an engagement part 26. In the recess 23 in the magazine 3, the end closer to the driving unit 2 forms an abutment 24 for the stop 22. When the stop 22 drops into the recess due to the pivoting force developed in the connector web 21, the spring 17 biasing the follower 16 toward the driving unit holds the stop 22 against the abutment 24.

After filling the magazine 3 with the fastening elements 4, the cover 6 is pivoted from the position shown in FIG. 3b to that shown in FIG. 3a, closing the magazine, so that at the end of the pivotal movement of the cover, an actuating member 25 on the inside of the cover, in the form a finger, acts on the rearwardly extending arm of the rocking lever 19 and serving as the engagement part 26. As can be seen in FIG. 1, during the pivotal movement of the cover 6 into the closed position, the actuating member 25 moves through an opening 27 in the rear edge of the follower body 18. As shown in FIG. 2, particularly by the enlarged detail of FIG. 2, the pivotal movement of the cover causes the actuating member 25 to contact the engagement part 26 with the stop 22 at the opposite end of the rocking lever being displaced out of engagement with the abutment 24 in the recess 23 moving the lever from the dot-dash neutral or engaged position, pivoting about the connector web 21, into the released position shown in full lines. Accordingly, the follower 16 is automatically released and is biased by the spring 17 in the feed direction for moving the nails 4 into the driving unit 2.

In FIG. 3*a* the magazine 3 is shown with the cover 6 pivoted into the closed position. The follower 16 is in a random transport position. For reasons of clarity, the nails 4 are not shown in FIGS. 3*a* and 3*b*.

The driving unit 2 can be a nail driver operated electrically or by compressed air.

While specific embodiments of the invention have been shown and described in detail to illustrate the application of the inventive principles, it will be understood that the invention may be embodied otherwise without departing from such principles.

We claim:

1. A device for driving fastening elements, includes means for driving the fastening elements in a first direction, a magazine for holding the fastening elements and for delivering the fastening elements to said means, said magazine being elongated in a second direction extending transversely of the first direction and having a first end through which the fastening elements are supplied to said driving means and a second end spaced outwardly from said means, a follower located within said magazine for moving the fastening elements in the second direction toward said first end of said magazine, said follower being displaceable in the second direction outwardly from said driving means to a loading position for placing fastening elements into said magazine, said follower has a stop thereon and said magazine has an abutment so that in the loading position said stop engages said abutment and retains said follower against displacement in the second direction toward said driving means, said follower includes means for pivoting said stop about an axis extending transversely of the second direction, an engagement part on said follower spaced from and in cooperating relation with said stop, and an actuating member movably displaceable on said magazine for contacting said engagement part and pivotally displacing said stop about the axis of said pivot means for releasing said follower out of the loading position, said follower includes a rocking lever having a pair of oppositely directed arms with the end of one arm forming said stop and the end of the other arm forming said engagement part, said follower includes a follower body, said means for pivoting said stop comprises a pivotal joint member forming the pivot axis and articulating said rocking lever to said follower body, said pivotal joint member comprises a connector web attached at one end to said follower body and at the other end to said rocking lever, and said follower body, said connector web and said rocking lever being formed monolithically.

2. A device for driving fastening elements, as set forth in claim 1, wherein said magazine includes a recess in the inside surface thereof with the recess extending in the in the second direction, the end of said recess closer to said driving means forming said abutment.

3. A device for driving fastening elements, as set forth in claim 1, wherein said follower body, connector web and rocking lever are formed of an elastic plastics material with said connector web being provided with a restoring force when said follower is in the loading position.

* * * * *